US009843110B2

(12) United States Patent
Spiel

(10) Patent No.: US 9,843,110 B2
(45) Date of Patent: Dec. 12, 2017

(54) MITIGATING CO-CHANNEL INTERFERENCE IN MULTI-RADIO DEVICES

(71) Applicant: Cisco Technology, Inc., San Jose, CA (US)

(72) Inventor: Seth Brandon Spiel, San Francisco, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 24 days.

(21) Appl. No.: 14/927,012

(22) Filed: Oct. 29, 2015

(65) Prior Publication Data

US 2017/0125920 A1 May 4, 2017

(51) Int. Cl.
*H01Q 19/10* (2006.01)
*H01Q 21/28* (2006.01)

(52) U.S. Cl.
CPC ..... *H01Q 21/28* (2013.01); *H01Q 19/10* (2013.01)

(58) Field of Classification Search
CPC ..... H01Q 21/28; H01Q 19/00
USPC ..... 343/836, 837
See application file for complete search history.

(56) References Cited

U.S. PATENT DOCUMENTS 5,392,057 A * 2/1995 Lin ..... H01Q 1/125 343/840
6,919,852 B2 * 7/2005 Desargant ..... H01Q 1/28 343/705
7,245,262 B2 * 7/2007 Kim ..... H01Q 3/20 343/757
7,411,561 B1 * 8/2008 Baldauf ..... H01Q 19/192 343/761
8,077,095 B2 12/2011 Suh et al.
8,254,343 B2 8/2012 Liu et al.
8,284,721 B2 10/2012 Chen et al.
8,909,165 B2 12/2014 Hendin
2003/0210202 A1 * 11/2003 Desargant ..... H01Q 1/28 343/837
2004/0090387 A1 * 5/2004 Desargant ..... H01Q 1/28 343/766
2013/0113672 A1 * 5/2013 Schneider ..... H01Q 1/1221 343/795
2014/0218255 A1 * 8/2014 Sanford ..... H01Q 1/525 343/837

* cited by examiner

*Primary Examiner* — Huedung Mancuso
(74) *Attorney, Agent, or Firm* — Ronald Fernando

(57) ABSTRACT

In one implementation, an apparatus includes: a first reflector portion having a first mount for a first antenna that is configured to operate in a first frequency range, where the first mount characterizes an emission point of a main lobe of the first antenna; and a second reflector portion having a second mount for a second antenna that is configured to operate in a second frequency range that overlaps the first frequency range, where the second mount characterizes an emission point of a main lobe of the second antenna. The second reflector portion is arranged relative to the first reflector portion in order to satisfy a near-field interference isolation criterion between the first and second antennae. In some implementations, the distance between the antenna mounts is less than a distance between the antenna mounts arranged in a plane due to increased spatial diversity between the first and second antennae.

19 Claims, 10 Drawing Sheets

MITIGATING CO-CHANNEL INTERFERENCE IN MULTI-RADIO DEVICES

TECHNICAL FIELD

The present disclosure relates generally to multi-radio devices, and in particular, to the mitigation of co-channel interference in multi-radio devices.

BACKGROUND

The ongoing development of data networks often involves enabling greater connectivity by expanding the area covered by a network and/or improving the robustness of accessible coverage within a particular area. Wireless access points (APs) simplify the deployment network infrastructure equipment and enable rapid installation and/or expansion of a network within a coverage area. As a result, various data networks, from local area networks (LANs) to wide area networks (WANs), now often include a number of wireless APs. Wireless APs also facilitate client device mobility by providing relatively seamless access to a network throughout a coverage area.

In order to satisfy demand, wireless APs include increasingly complicated and power hungry hardware in order to support wireless connectivity. For example, wireless APs typically include several radio frequency (RF) radios in order to both provide sufficient coverage and accommodate various networking protocols (e.g., IEEE 802.11g, IEEE 802.11n, IEEE 802.11ac, IEEE 802.15, BLUETOOTH, ZigBee, and the like).

For example, a wireless access point may include two or more RF radios (i.e., radio frequency transceivers) operating in the 2.4 GHz band or the 5 GHz band in accordance with one or more variants specified under IEEE 802.11 or other wireless standards such as IEEE 802.15, BLUETOOTH, or the like. As a result, co-channel interference may occur between the RF radios as they operate in a same frequency band. Spatial diversity between the RF radios can be used to reduce co-channel interference. However, known spatial diversity arrangements suitable for reducing co-channel interference are based on placing RF radios as far apart as possible. In view of a number of factors, there is typically a preference for wireless access points that are relatively small and that have a discreet form factor. As such, using known arrangements, the amount of physical separation between RF radios is limited by the preferred size and form factor of a typical wireless access point.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
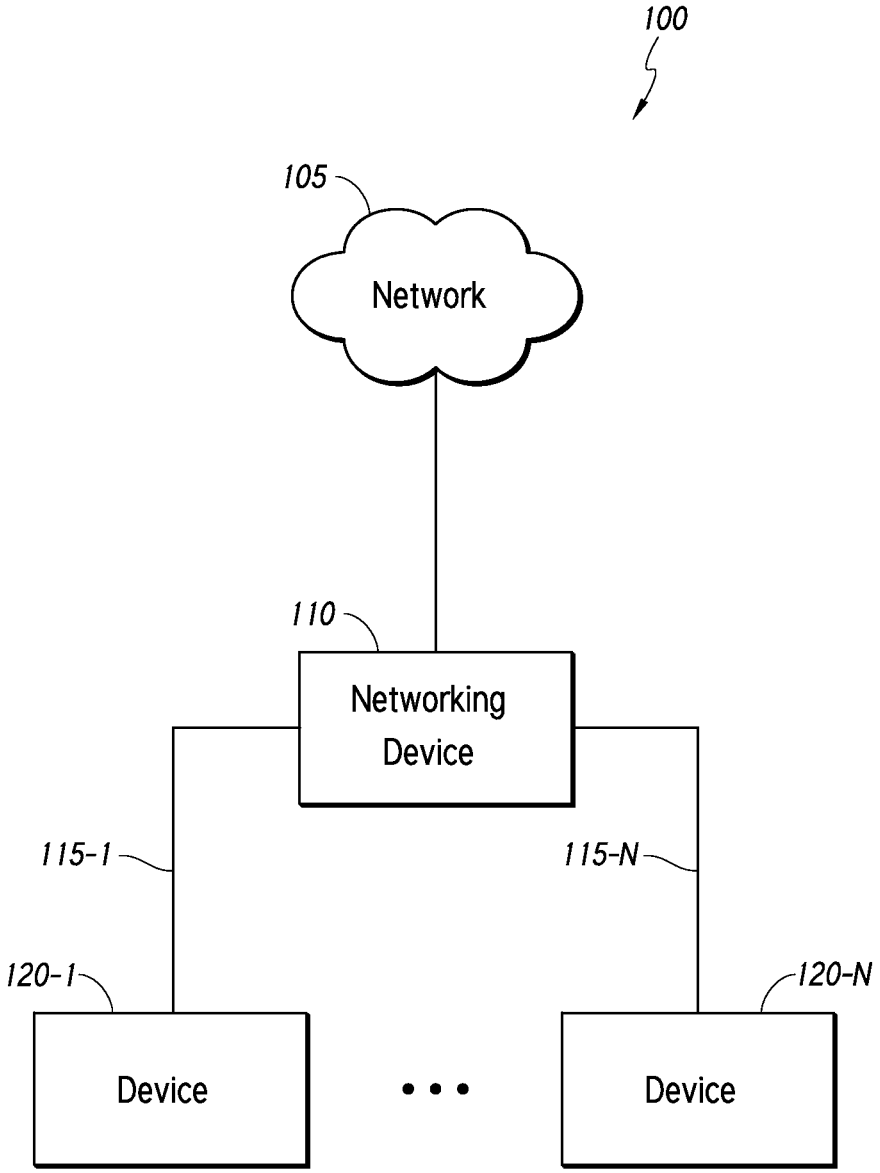
FIG. 1 is a block diagram of a data network in accordance with some implementations.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the figures.

DESCRIPTION OF EXAMPLE EMBODIMENTS

Numerous details are described herein in order to provide a thorough understanding of the illustrative implementations shown in the accompanying drawings. However, the accompanying drawings merely show some example aspects of the present disclosure and are therefore not to be considered limiting. Those of ordinary skill in the art will appreciate from the present disclosure that other effective aspects and/or variants do not include all of the specific details of the example implementations described herein. While pertinent features are shown and described, those of ordinary skill in the art will appreciate from the present disclosure that various other features, including well-known systems, methods, components, devices, and circuits, have not been illustrated or described in exhaustive detail for the sake of brevity and so as not to obscure more pertinent aspects of the example implementations disclosed herein.

Overview

Various implementations disclosed herein include apparatuses, devices, and systems for providing spatial diversity between at least two antennae without increasing the size or form factor of a networking device. For example, in some implementations, an apparatus includes: a first reflector portion having a first mount for a first antenna that is configured to operate in a first frequency range, where the first mount characterizes an emission point of a main lobe of the first antenna; and a second reflector portion having a second mount for a second antenna that is configured to operate in a second frequency range that overlaps the first frequency range, where the second mount characterizes an emission point of a main lobe of the second antenna. The second reflector portion is arranged relative to the first reflector portion in order to satisfy a near-field interference isolation criterion between the first and second antennae. In some implementations, the distance between the first and second antenna mounts is less than a distance between the first and second antenna mounts arranged in a plane due to increased spatial diversity between the first and second antennae.

Example Embodiments

Figure 3:
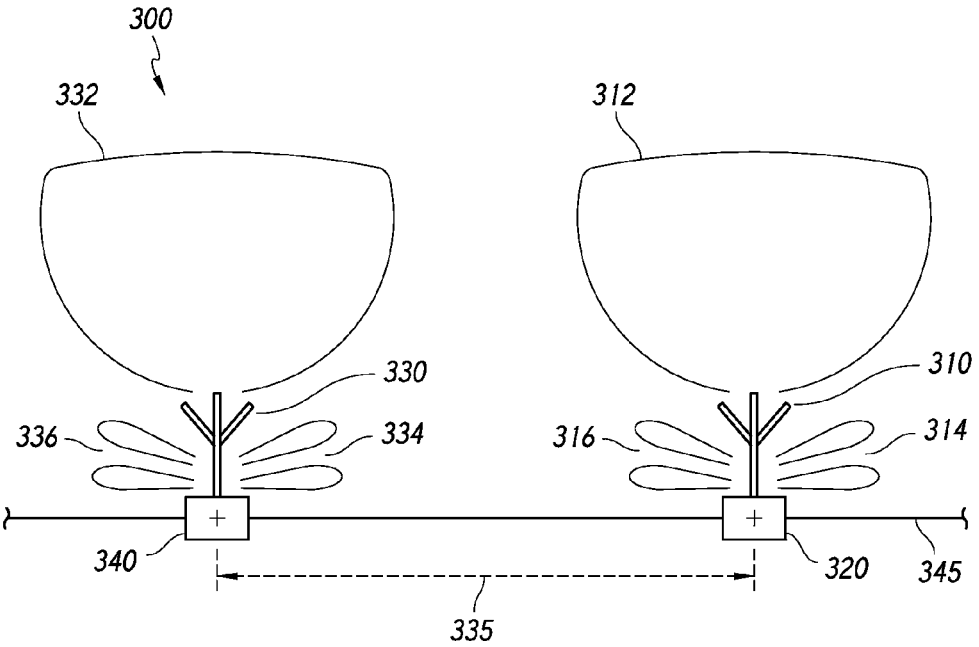
FIG. 3 is a side view of an example antennae arrangement in accordance with some implementations.
Figure 4A:
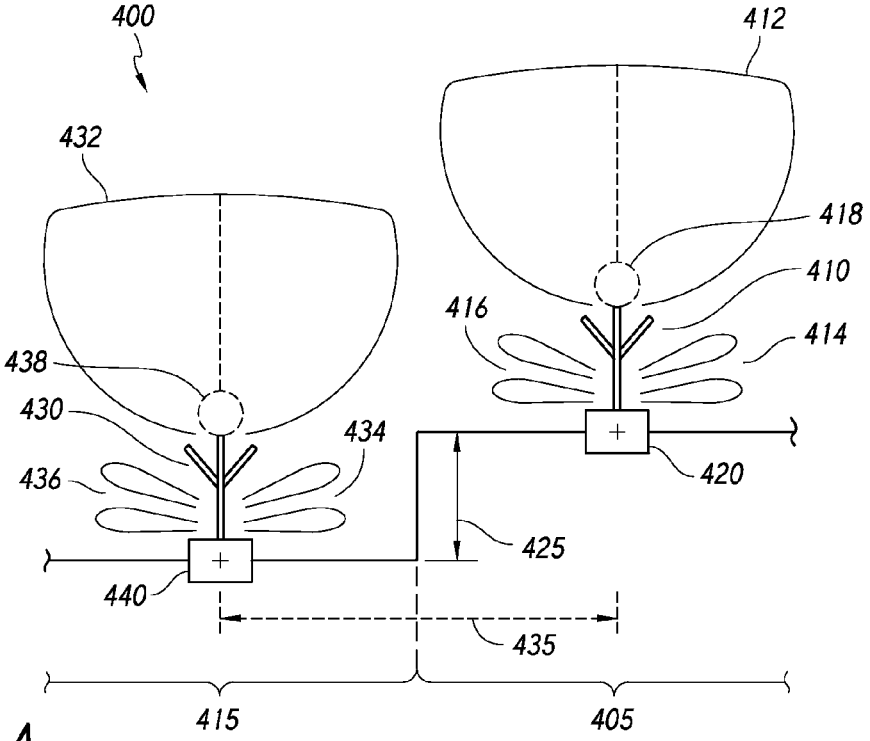
FIG. 4A is a side view of an example tiered antennae arrangement in accordance with some implementations.
Figure 5A:
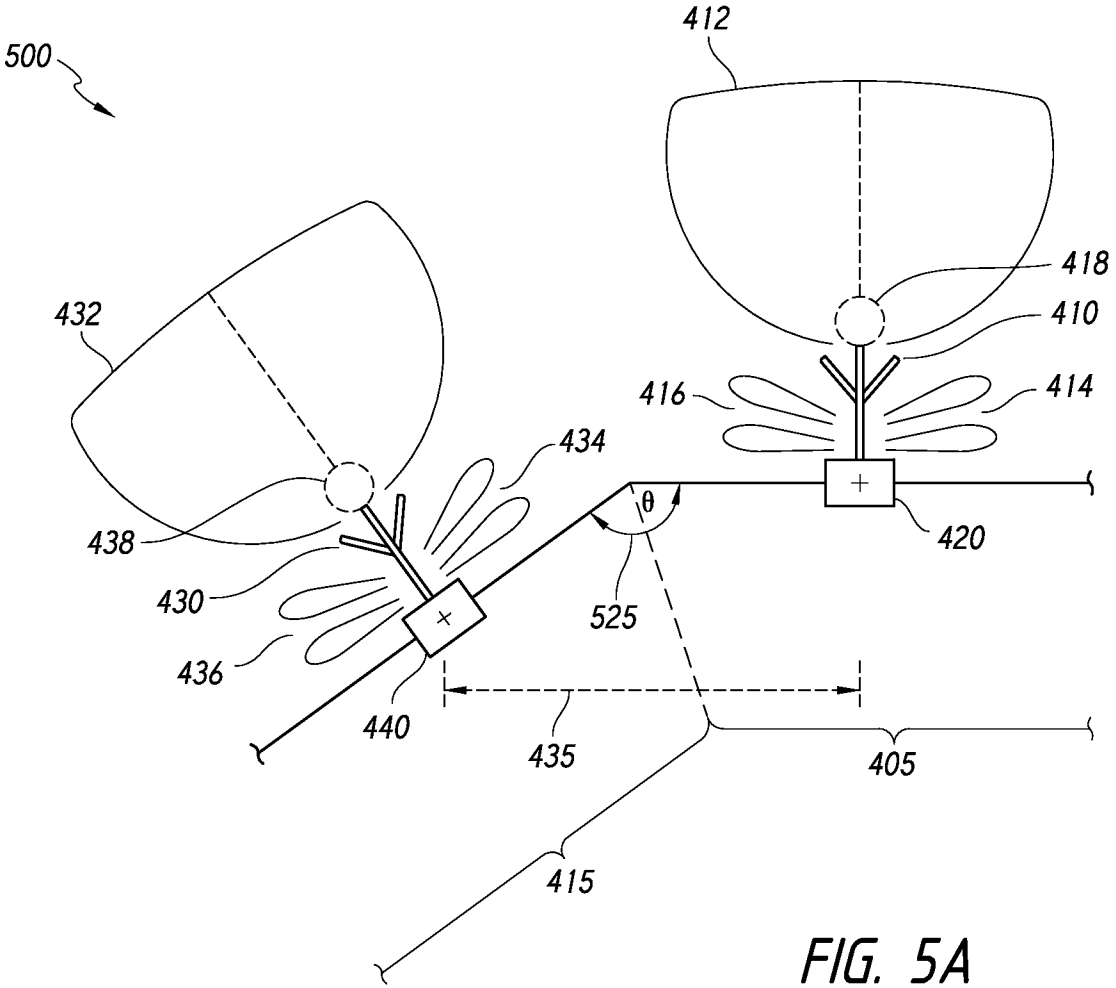
FIG. 5A is a side view of an example inclined antennae arrangement in accordance with some implementations.

Typical networking devices (e.g., wireless access points, switches, or network routers) may include several radio frequency (RF) radio transmitters (i.e., antennae). As one example, a networking device includes a first antenna operating according to Institute of Electrical and Electronics Engineers (IEEE) 802.11n, a second antenna operating according to BLUETOOTH, and a third scanning antenna. In this example, the first and second antennae both operate in the 2.4 GHz band, which results in co-channel interference (i.e., crosstalk between radio transmitters operating in a same frequency band) between the first and second antennae. To that end, a second reflector portion of the networking device having a second antenna mount for the second antenna is arranged relative to a first reflector portion in order to satisfy a near-field interference isolation criterion between the first and second antennae (e.g., a threshold co-channel interference limit such as a predefined number of decibels). In some implementations, co-channel interference between the first and second antennae may be eliminated or substantially reduced by arranging a first reflector portion having a first antenna mount for the first antenna relative to a second reflector portion having a second antenna mount for the second antenna in a tiered antennae arrangement as shown in FIG. 4A. In some implementations, co-channel interference between the first and second antennae may be eliminated or substantially reduced by arranging a first reflector portion having a first antenna mount for the first antenna relative to a second reflector portion having a second antenna mount for the second antenna in an inclined antennae arrangement as shown in FIG. 5A. In some implementations, the distance between the first and second antenna mounts is less than a distance between the first and second antenna mounts arranged in a same plane due to increased spatial diversity between the first and second antennae as shown in FIG. 3. As such, the arrangement between the first and second antenna portions (e.g., step or inclined) provides spatial diversity without increasing the form factor or physical size of the networking device.

FIG. 1 is a block diagram of a data network 100 in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the data network 100 includes a networking device 110 (e.g., a network router, a switch, or wireless access point [AP]) that provides access to a network 105 for a number of devices 120-1, . . . , 120-N. The network 105 may include any public or private LAN (local area network) and/or WAN (wide area network), such as an intranet, an extranet, a virtual private network, and/or portions of the Internet.

In some implementations, one or more of the devices 120-1, . . . , 120-N are client devices including hardware and software for performing one or more functions. Example client devices include, without limitation, desktop computers, laptops, video game systems, tablets, mobile phones, media playback systems, wearable computing devices, IP (internet protocol) cameras, VoIP (Voice-over-IP) phones, intercoms and public address systems, clocks, sensors, access controllers (e.g., keycard readers), lighting controllers, security systems, building management systems, or the like. In some implementations, one or more of the devices 120-1, . . . , 120-N may be virtual devices that consume power through the use of underlying hardware.

The networking device 110 (which may also be referred to as an AP, a switch, or a network router) receives and transmits data between the network 105 and the devices 120-1, . . . , 120-N. In some implementations, the networking device 110 manages the flow of data of the data network 100 by transmitting messages (e.g., data packets) received from the network 105 to the devices 120-1, . . . , 120-N for which the messages are intended. The networking device 110 is communicatively coupled to each of the devices 120-1, . . . , 120-N via respective transmission media 115, which may be wired or wireless. For example, in some implementations, the networking device 110 is coupled to at least one of the devices 120-1, . . . , 120-N via an Ethernet cable. For example, in other implementations, the networking device 110 is coupled to at least one of the devices 120-1, . . . , 120-N via a wireless networking specification such as IEEE 802.11a, IEEE 802.11b, IEEE 802.11g, IEEE 802.11n, IEEE 802.11ac, IEEE 802.11ad, IEEE 802.15, or the like.

Figure 2:
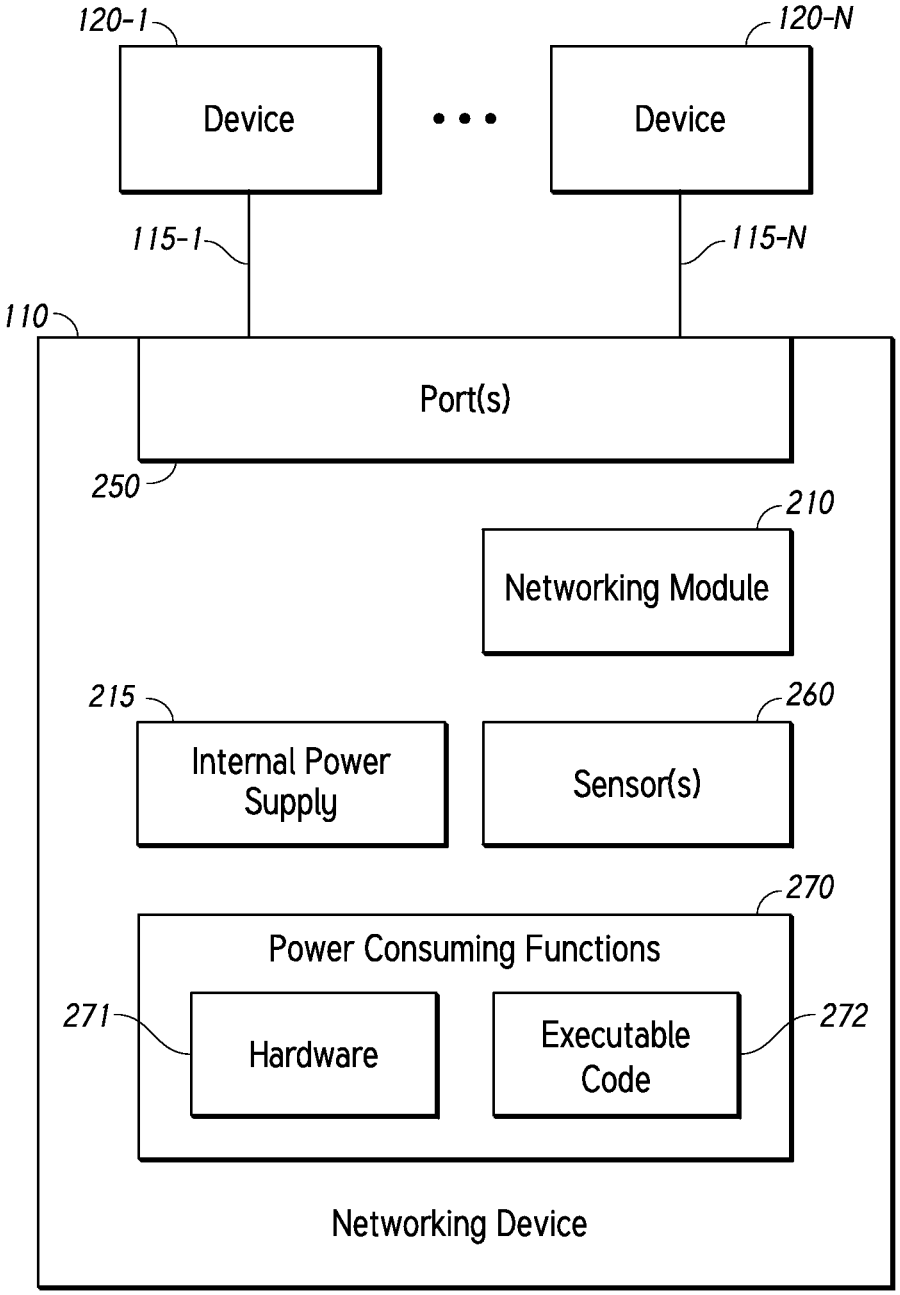
FIG. 2 is a block diagram of a networking device in accordance with some implementations.

FIG. 2 is a block diagram of the networking device 110 in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the networking device 110 includes one or more ports 250 for coupling to the devices 120-1, . . . , 120-N via respective transmission media 115. The transmission media 115 may be a wired or wireless transmission medium. In one example, the transmission media 115 are Ethernet cables and the one or more ports 250 are Ethernet ports. In another example, the one or more ports 250 are USB ports or the like.

In some implementations, the networking device 110 includes a networking module 210 configured to route data to and/or from the devices 120-1, . . . , 120-N. Although the networking device 110 may receive power from an external source (e.g., an AC outlet, via a Power-over-Ethernet (PoE) standard from a switching hub, inductive means, or the like), it is to be appreciated that the networking device 110 may include an optional internal power supply 215 such as one or more batteries.

In some implementations, the networking device 110 also includes one or more sensors 260 such as a temperature sensor, a pressure sensor, a humidity sensor, a light sensor, an infrared sensor, and/or a position sensor such as an accelerometer, magnetometer, gyroscope, proximity sensor, and/or GPS (global positioning system) sensor. The networking device 110 may include other types of sensors 260 such as a camera, a chemical sensor, a microphone, and/or the like.

In some implementations, the networking device 110 enables one or more power consuming functions 270 (e.g., features of the networking device 110) according to various factors such as client demand, power available, and/or the like. The power consuming functions 270 may include hardware 271 and/or executable code 272. For example, in some implementations, the hardware 271 includes backup 2.4 GHz or 5.0 GHz radios, interference scanning, BLUETOOTH/BLUETOOTH Low Energy radios, or additional data ports (e.g., USB or Ethernet ports). In some implementations, the executable code 272 includes software for performing one or more functions such as security functionality or spectral analysis.

In some implementations, in order to enable a power consuming function 270 including hardware 271, the networking device 110 enables power received via the port 250 to activate the hardware 271, transmits a signal to the hardware 271 to activate it, transmits a signal to other hardware that enables power to activate the hardware 271, or the like. In some implementations, in order to enable a power consuming function 270 including executable code 272, the networking device 110 instructs a processor to execute the executable code 272.

FIG. 3 is a side view of an example antennae arrangement 300 in accordance with some implementations. In some implementations, the antennae arrangement 300 includes a reflector 345 having a first antenna mount 320 provided for a first antenna 310 and a second antenna mount 340 provided for a second antenna 330. As shown in FIG. 3, the first antenna mount 320 and the second antenna mount 340 are co-located in a same plane.

As shown in FIG. 3, the radiation pattern for the first antenna 310 includes a main lobe 312 (e.g., a hemispherical shape) and side lobes 314, 316. Similarly, the radiation pattern for the second antenna 330 includes a main lobe 332 and side lobes 334, 336. Those of ordinary skill in the art will appreciate from the present disclosure that the antenna radiation patterns illustrated in FIG. 3 are provided merely as examples, and that antennae with various other types of radiation patterns are suitable for various other implementations.

The first antenna 310 operates in a first frequency range, and the second antenna 330 operates in a second frequency range, where the first and second frequency ranges at least partially overlap. Thus, in some implementations, the first antenna 310 and the second antenna 330 experience co-channel interference (e.g., antenna-to-antenna near-field interference) from one another due to destructive antenna-to-antenna interference from operating in at least partially overlapping frequency bands. In some implementations, the lowest frequency of the first frequency range is one of: 2.4 GHz and 5 GHz. In order to establish spatial diversity between the first antenna 310 and the second antenna 330 and reduce the effect of co-channel interference, the first antenna mount 320 and the second antenna 340 are separated by a distance of 335 (e.g., measured from the center of the first mount 320 to the center of the second mount 340).

FIG. 4A is a side view of an example tiered antennae arrangement 400 in accordance with some implementations. In some implementations, the tiered antennae arrangement 400 includes a first reflector portion 405 having a first antenna mount 420 provided for a first antenna 410 and a second reflector portion 415 having a second antenna mount 440 provided for a second antenna 430. In some implementations, the first reflector portion 405 and the second reflector portion 415 form a common ground plane. For example, the first reflector portion 405 and the second reflector portion 415 are electrically and/or mechanically coupled as shown in FIG. 4A.

In some implementations, the first antenna 410 is an omnidirectional radio transceiver that operates according to one or more of the following wireless networking protocols: IEEE 802.11b, IEEE 802.11g, IEEE 802.11n, IEEE 802.11ac, IEEE 802.15, and/or the like. In some implementations, the first antenna 410 is an N×N multiple-input multiple-output (MIMO) radio transceiver with N receive chains and N transmit chains in order to support N bidirectional streams. In some implementations, the second antenna 430 is one of a BLUETOOTH radio transceiver, a ZigBee radio transceiver, a clear channel radio transceiver, a scanning radio transceiver, or the like.

The first antenna 410 operates in a first frequency range, and the second antenna 430 operates in a second frequency range. For example, if the first antenna 410 is operating according to IEEE 802.11ac, the first frequency range is between 5170 MHz to 5825 MHz. In another example, if the first antenna 410 is operating according to BLUETOOTH, the first frequency range corresponds to the Industrial, Scientific, and Medical (ISM) radio band between 2400 MHz to 2485 MHz. In some implementations, the first and second frequency ranges at least partially overlap. In some implementations, the first and second frequency ranges are identical. Thus, in some implementations, the first antenna 410 and the second antenna 430 potentially experience co-channel interference (e.g., antenna-to-antenna near-field interference) from one another due to destructive antenna-to-antenna interference from operating in at least partially overlapping frequency bands.

As shown in FIG. 4A, the radiation pattern for the first antenna 410 includes a main lobe 412 (e.g., a hemispherical shape) with an emission point 418 and side lobes 414, 416. Similarly, the radiation pattern for the second antenna 430 includes a main lobe 432 with an emission point 438 and side lobes 434, 436. Those of ordinary skill in the art will appreciate from the present disclosure that the antenna radiation patterns illustrated in FIG. 4A are provided merely as examples, and that antennae with various other types of radiation patterns are suitable for various other implementations.

In some implementations, the first antenna mount 420 characterizes the emission point 418 of the main lobe 412 of the first antenna 410. For example, the origin point of the main lobe 412 of the first antenna 410 is characterized by the center of the first antenna mount 420. In another example, the origin point of the main lobe 412 of the first antenna 410 is characterized by a point of the first antenna mount 420 that is off-center. Similarly, in some implementations, the second antenna mount 440 characterizes the emission point 438 of the main lobe 432 of the second antenna 420. For example, the origin point of the main lobe 432 of the second antenna 430 is characterized by the center of the second antenna mount 440. In another example, the origin point of the main lobe 432 of the second antenna 430 is characterized by a point of the second antenna mount 440 that is off-center.

In some implementations, the first antenna mount 420 includes a depression stamped into the first reflector portion 405 for receiving and mounting the first antenna 410. In some implementations, the first antenna mount 420 is a hole within the first reflector portion 405 for receiving and mounting the first antenna 410. In some implementations, the first antenna mount 420 is a structure for receiving and mounting the first antenna 410. Those of ordinary skill in the art will appreciate from the present disclosure that, in various implementations, the second antenna mount 440 is configured similarly to the first antenna amount 420. Therefore, the second antenna mount 440 will not be described in detail for the sake of brevity.

In some implementations, the first reflector portion 405 is defined by a first plane, and the second reflector portion 415 is defined by a second plane. In some implementations, the first reflector portion 405 resides in the first plane, and the second reflector portion 415 resides in the second plane. In some implementations, the first plane is characterized by a tangential plane relative to a point on the first reflector portion 405 and the second plane is characterized by a tangential plane relative to a point on the second reflector portion 415. Put another way, the first reflector portion 405 and the second reflector portion 415 are curved. As such, in one example, the first reflector portion 405 and the second reflector portion 415 have a concave shape.

In some implementations, the direction of the main lobe 412 of the first antenna 410 is perpendicular to and away from the first plane in which the first reflector portion 405 resides. As such, the main lobe 412 of the first antenna 410 is directed away from the first reflector portion 405, and the first reflector re-directs any back lobe(s) of the first antenna 410 in the same direction as the main lobe 412. Similarly, the direction of the main lobe 432 of the second antenna 430 is perpendicular to and away from the second plane in which the second reflector portion 415 resides.

As shown in FIG. 4A, the first and second planes are offset, parallel planes. In other words, the first reflector portion 405 and the second reflector portion 415 are disposed in a tiered antennae arrangement, in FIG. 4A, whereby the first reflector portion 405 is located at a higher elevation than the second reflector portion 415. In some implementations, the offset 425 between the first and second planes is set in order to a satisfy near-field interference isolation criterion between the first antenna 410 and the second antenna 430. For example, the offset 425 between the first and second planes is set such that the near-field interference between the first antenna 410 and the second antenna 430 is less than a threshold value (e.g., in dB).

In some implementations, the distance 435 between the first antenna mount 420 and the second antenna mount 440 in the tiered antennae arrangement 400 shown in FIG. 4A is less than the distance 335 between the first antenna mount 320 and the second antenna mount 340 arranged in a same plane in FIG. 3 due to increased spatial diversity between the first and second antennae. Put another way, if the first and second antenna mounts were located in a same plane (as is the case with antenna mounts 320, 340 in FIG. 3), the distance between the first and second antenna mounts (e.g., the distance 335 in FIG. 3) to establish spatial diversity between the first and second antennae would be greater than the distance between the first and second antenna mounts (e.g., the distance 435 in FIG. 4A) in the tiered antennae arrangement 400 in FIG. 4A. As such, the tiered antennae arrangement 400 in FIG. 4A provides mutual isolation between the first antenna 410 and the second antenna 430, which operate in substantially overlapping frequency bands, to reduce antenna-to-antenna near-field interference.

As a result, the effective spatial distance between the first antenna 410 and the second antenna 430 is increased without increasing the physical distance between the first antenna mount 420 and the second antenna mount 440 and/or the size/form factor of the apparatus including the first antenna 410 and the second antenna 430 (e.g., a wireless AP, switch, or network router). For example, the tiered antennae arrangement 400 in FIG. 4A eliminates or at least substantially reduces the effect of side lobes 434 on the main lobe 412 of the first antenna 410. Continuing with this example, the tiered antennae arrangement 400 in FIG. 4A eliminates or at least substantially reduces the effect of side lobes 416 on the main lobe 432 of the second antenna 430.

Alternatively, in some implementations, the distance 435 between the first antenna mount 420 and the second antenna mount 440 in the tiered antennae arrangement 400 shown in FIG. 4A is the same as the distance 335 between the first antenna mount 320 and the second antenna mount 340 arranged in a same plane in FIG. 3, but the spatial diversity between the first antenna mount 420 and the second antenna mount 440 is greater than that between the first antenna mount 320 and the second antenna mount 340 due to the tiered antennae arrangement 400. In other words, the tiered antennae arrangement 400 increases the spatial diversity between the first and second antenna mounts due to the offset 425.

Figure 4B:
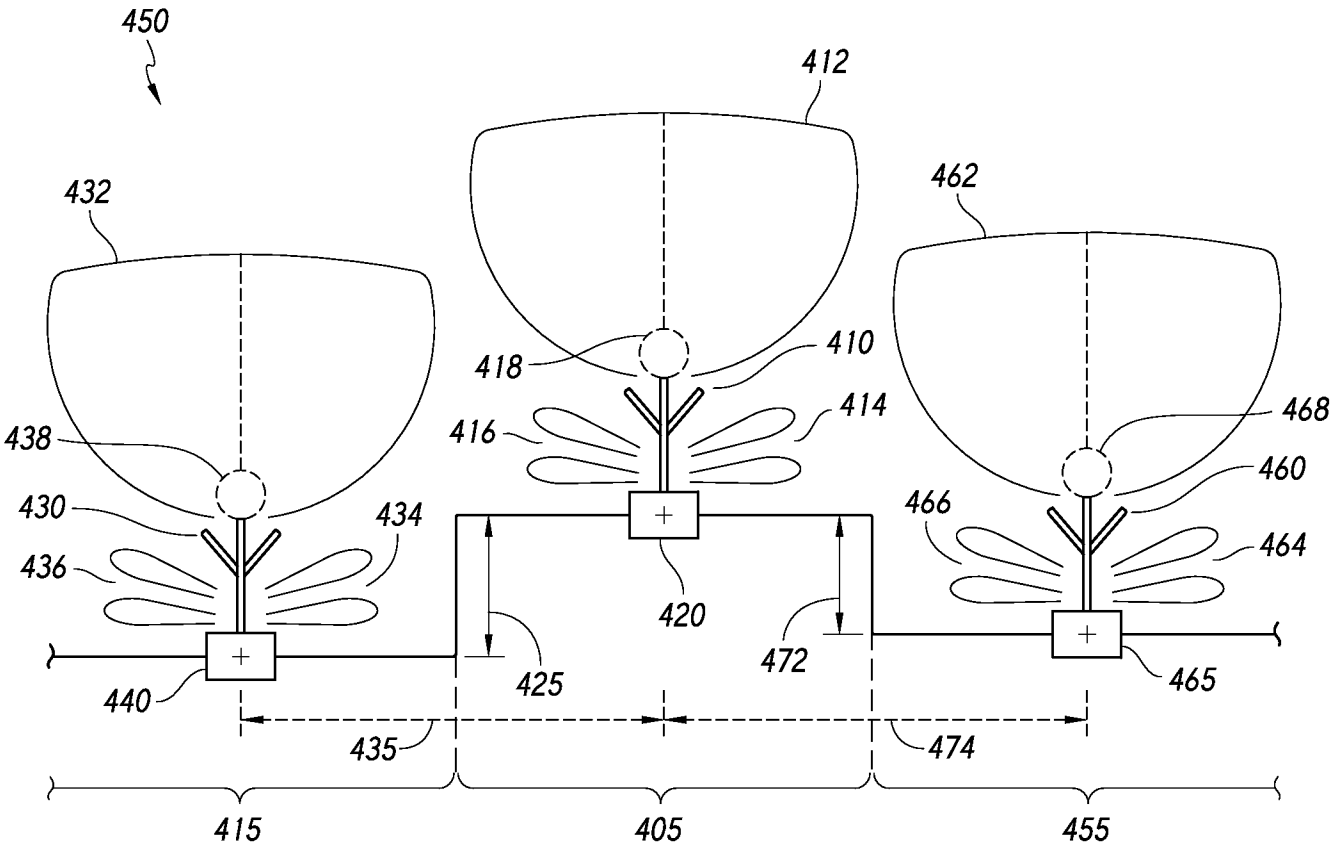
FIG. 4B is a side view of another example tiered antennae arrangement in accordance with some implementations.

FIG. 4B is a side view of another example tiered antennae arrangement 450 in accordance with some implementations. In FIG. 4B, the components of the tiered antennae arrangement 450 are similar to and adapted from those discussed above with reference to the tiered antennae arrangement 400 in FIG. 4A. Elements common to FIGS. 4A and 4B include common reference numbers, and only the differences between FIGS. 4A and 4B are described herein for the sake of brevity. To that end, in some implementations, the tiered antennae arrangement 450 includes a first reflector portion 405 having a first antenna mount 420 provided for a first antenna 410, a second reflector portion 415 having a second antenna mount 440 provided for a second antenna 430, and a third reflector portion 455 having a third antenna mount 465 provided for a third antenna 460. In some implementations, the first reflector portion 405, the second reflector portion 415, and the third reflector portion 455 form a common ground plane. For example, the first reflector portion 405, the second reflector portion 415, and the third reflector portion 455 are electrically and/or mechanically coupled as shown in FIG. 4B.

In some implementations, the third antenna 460 is one of a BLUETOOTH radio transceiver, a ZigBee radio transceiver, a clear channel radio transceiver, a scanning radio transceiver, or the like. As shown in FIG. 4B, the radiation pattern for the third antenna 460 includes a main lobe 462 with an emission point 468 and side lobes 464, 466. Those of ordinary skill in the art will appreciate from the present disclosure that the antenna radiation patterns illustrated in FIG. 4B are provided merely as examples, and that antennae with various other types of radiation patterns are suitable for various other implementations.

Those of ordinary skill in the art will appreciate from the present disclosure that, in various implementations, the third antenna mount 465 is configured similarly to the first antenna amount 420 and the second antenna mount 440 as described with reference to FIG. 4A. Therefore, the third antenna mount 465 will not be described in detail for the sake of brevity. In some implementations, the third antenna mount 465 characterizes the emission point 468 of the main lobe 462 of the third antenna 460. For example, the origin point of the main lobe 412 of the third antenna 460 is characterized by the center of the third antenna mount 465. In another example, the origin point of the main lobe 462 of the third antenna 460 is characterized by a point of the third antenna mount 465 that is off-center.

The first antenna 410 operates in a first frequency range, the second antenna operates in a second frequency range, and the third antenna 460 operates in a third frequency range. In some implementations, the first, second, and third frequency ranges at least partially overlap. In some implementations, the first, second, and third frequency ranges are identical. Thus, in some implementations, the first antenna 410, the second antenna 430, and the third antenna 460 potentially experience co-channel interference (e.g., antenna-to-antenna near-field interference) from one another due to destructive antenna-to-antenna interference from operating in at least partially overlapping frequency bands.

In some implementations, the first reflector portion 405 is defined by a first plane, the second reflector portion 415 is defined by a second plane, and the third reflector portion 455 is defined by a third plane. In some implementations, the first reflector portion 405 resides in the first plane, the second reflector portion 415 resides in the second plane, and the third reflector portion 455 resides in the third plane. In some implementations, the third plane is characterized by a tangential plane relative to a point on the third reflector portion 455. Put another way, the third reflector portion 455 are curved. As such, in one example, the third reflector portion 455 has a concave shape.

As shown in FIG. 4B, the first, second, and third planes are offset, parallel planes. In other words, the first reflector portion 405, the second reflector portion 415, and the third reflector portion 455 are disposed in a tiered antennae arrangement 450, in FIG. 4B, whereby the first reflector portion 405 is located at a higher elevation than the second reflector portion 415 and the third reflector portion 455. Moreover, as shown in FIG. 4B, the third reflector portion 455 is located at a higher elevation than the second reflector portion 415. In other words, as one example, in FIG. 4B, the offset 472 is less than the offset 425. In some implementations, the offset 472 between the first and third planes is set in order to a satisfy near-field interference isolation criterion between the first antenna 410 and the third antenna 460. For example, the offset 472 between the first and third planes is set such that the near-field interference between the first antenna 410 and the third antenna 460 is less than a threshold value (e.g., in dB).

Alternatively, in some implementations, the third reflector portion 455 is located at a higher elevation than the first reflector portion 405 and the second reflector portion 415, and the second reflector portion 415 and located at a higher elevation than the first reflector portion 405. In other words, the reflector portions are disposed in a stair arrangement where the relative elevations of the reflector portions are as follows: the third reflector portion 455>the second reflector portion 415>the first reflector portion 405.

In various implementations, the distance 474 between the first antenna mount 420 and the third antenna mount 465 in the tiered antennae arrangement 450 shown in FIG. 4B is less than the distance 335 between the first antenna mount 320 and the second antenna mount 340 arranged in a same plane in FIG. 3 due to increased spatial diversity between the first and second antennae. Put another way, if the first and third antenna mounts were located in a same plane (as is the case with antenna mounts 320, 340 in FIG. 3), the distance between the first and third antenna mounts (e.g., the distance 335 in FIG. 3) to establish spatial diversity between the first and third antennae would be greater than the distance between the first and third antenna mounts (e.g., the distance 474 in FIG. 4B) in the tiered antennae arrangement 450 in FIG. 4B. As such, the tiered antennae arrangement 450 in FIG. 4B provides mutual isolation between the first antenna 410 and the third antenna 460, which operate in substantially overlapping frequency bands, to reduce antenna-to-antenna near-field interference.

As a result, the effective spatial distance between the first antenna 410 and the third antenna 460 is increased without increasing the physical distance between the first antenna mount 420 and the third antenna mount 465 and/or the size/form factor of the apparatus including the first antenna 410, the second antenna 430, and the third antenna 460 (e.g., a wireless AP, switch, or network router). For example, the tiered antennae arrangement 450 in FIG. 4B eliminates or at least substantially reduces the effect of side lobes 466 on the main lobe 412 of the first antenna 410. Continuing with this example, the tiered antennae arrangement 450 in FIG. 4B eliminates or at least substantially reduces the effect of side lobes 414 on the main lobe 462 of the third antenna 460.

FIG. 5A is a side view of an example inclined antennae arrangement 500 in accordance with some implementations. In FIG. 5A, the components of the inclined antennae arrangement 500 are similar to and adapted from those discussed above with reference to the tiered antennae arrangement 400 in FIG. 4A. Elements common to FIGS. 4A and 5A include common reference numbers, and only the differences between FIGS. 4A and 5A are described herein for the sake of brevity. To that end, in accordance with some implementations, the inclined antennae arrangement 500 includes a first reflector portion 405 having a first antenna mount 420 provided for a first antenna 410 and a second reflector portion 415 having a second antenna mount 440 provided for a second antenna 430. In some implementations, the first reflector portion 405 and the second reflector portion 415 form a common ground plane. For example, the first reflector portion 405 and the second reflector portion 415 are electrically and/or mechanically coupled as shown in FIG. 5A.

In some implementations, the first reflector portion 405 is defined by a first plane, and the second reflector portion 415 is defined by a second plane. In some implementations, the first reflector portion 405 resides in the first plane, and the second reflector portion 415 resides in the second plane. As shown in FIG. 5A, the second plane characterizing the second reflector portion 415 intersects the first plane characterizing the first reflector portion 405 at angle 525. In other words, the first reflector portion 405 and the second reflector portion 415 are disposed in an inclined antennae arrangement, in FIG. 5A, whereby the second reflector portion 415 is positioned at the angle 525 relative to the first reflector portion 405. In some implementations, the angle 525 is set in order to satisfy a near-field interference isolation criterion between the first and second antennae. For example, the angle 525 between the first and second planes is set such that the near-field interference between the first antenna 410 and the second antenna 430 is less than a threshold value (e.g., in dB). In one example, the angle 525 is between 90° to 180°.

In some implementations, the distance 435 between the first antenna mount 420 and the second antenna mount 440 in the inclined antennae arrangement 500 shown in FIG. 5A is less than the distance 335 between the first antenna mount 320 and the second antenna mount 340 arranged in a same plane in FIG. 3 due to increased spatial diversity between the first and second antennae. Put another way, if the first and second antenna mounts were located in a same plane (as is the case with antenna mounts 320, 340 in FIG. 3), the distance between the first and second antenna mounts (e.g., the distance 335 in FIG. 3) to establish spatial diversity between the first and second antennae would be greater than the distance between the first and second antenna mounts (e.g., the distance 435 in FIG. 5A) in the inclined antennae arrangement 500 in FIG. 5A. As such, the inclined antennae arrangement 500 in FIG. 5A provides mutual isolation between the first antenna 410 and the second antenna 430, which operate in substantially overlapping frequency bands, to reduce antenna-to-antenna near-field interference.

As a result, the effective spatial distance between the first antenna 410 and the second antenna 430 is increased without increasing the physical distance between the first antenna mount 420 and the second antenna mount 440 and/or the size/form factor of the apparatus including the first antenna 410 and the second antenna 430 (e.g., a wireless AP, switch, or network router). For example, the inclined antennae arrangement 500 in FIG. 5A eliminates or at least substantially reduces the effect of side lobes 434 on the main lobe 412 of the first antenna 410. Continuing with this example, the inclined antennae arrangement 500 in FIG. 5A eliminates or at least substantially reduces the effect of side lobes 416 on the main lobe 432 of the second antenna 430.

Figure 5B:
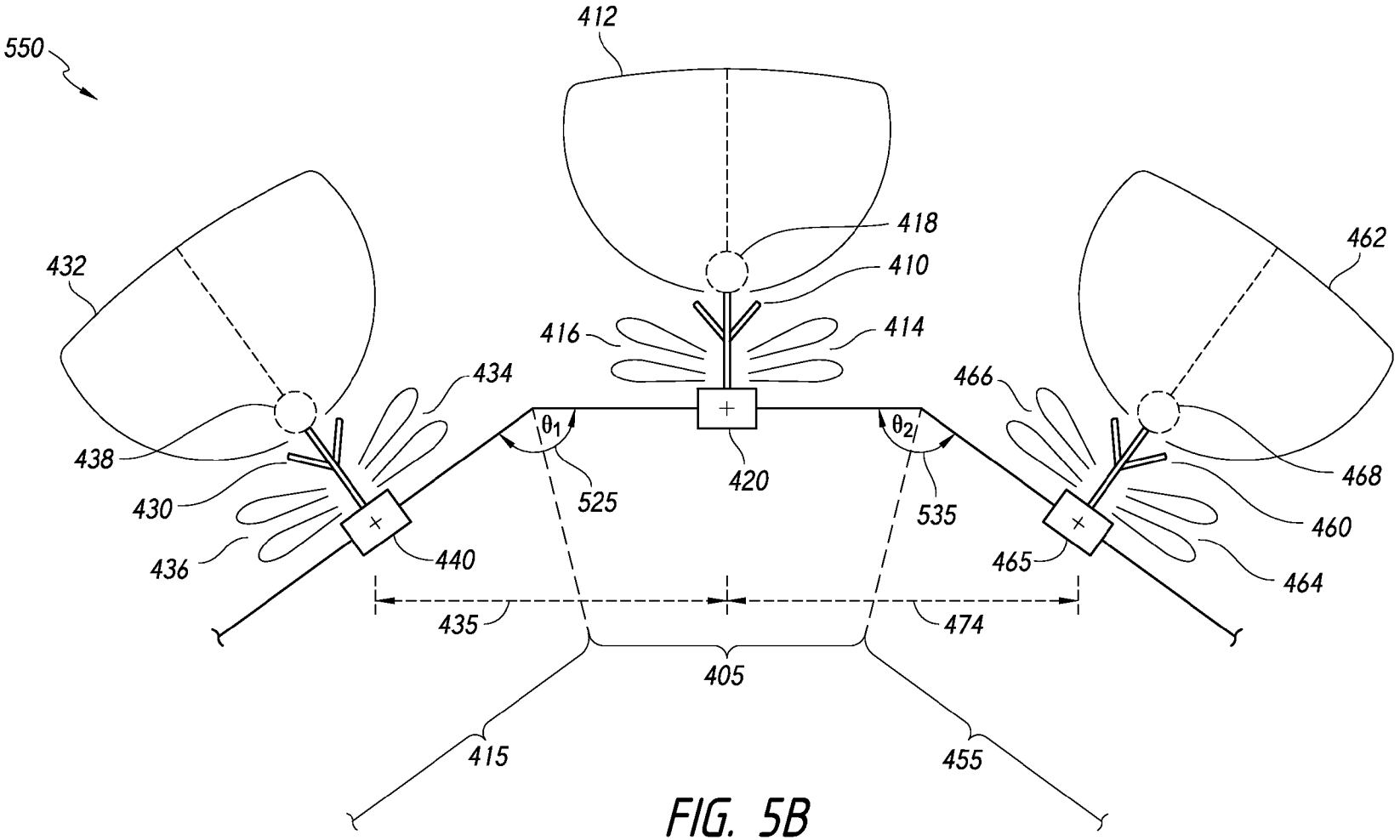
FIG. 5B is a side view of another example inclined antennae arrangement in accordance with some implementations.

FIG. 5B is a side view of another example inclined antennae arrangement 550 in accordance with some implementations. In FIG. 5B, the components of the inclined antennae arrangement 550 are similar to and adapted from those discussed above with reference to the tiered antennae arrangement 450 in FIG. 4B and the inclined antennae arrangement 500 in FIG. 5A. Elements common to FIGS. 4B, 5A, and 5B include common reference numbers, and only the differences between FIGS. 4B, 5A, and 5B are described herein for the sake of brevity. To that end, in some implementations, the inclined antennae arrangement 550 includes a first reflector portion 405 having a first antenna mount 420 provided for a first antenna 410, a second reflector portion 415 having a second antenna mount 440 provided for a second antenna 430, and a third reflector portion 455 having a third antenna mount 465 provided for a third antenna 460. In some implementations, the first reflector portion 405, the second reflector portion 415, and the third reflector portion 455 form a common ground plane. For example, the first reflector portion 405, the second reflector portion 415, and the third reflector portion 455 are electrically and/or mechanically coupled as shown in FIG. 5B.

In some implementations, the first reflector portion 405 is defined by a first plane, the second reflector portion 415 is defined by a second plane, and the third reflector portion 455 is defined by a third plane. As shown in FIG. 5B, the third plane characterizing the third reflector portion 455 intersects the first plane characterizing the first reflector portion 405 at angle 535. In other words, the first reflector portion 405 and the third reflector portion 455 are disposed in an inclined antennae arrangement, in FIG. 5B, whereby the third reflector portion 455 is positioned at the angle 535 relative to the first reflector portion 405. In some implementations, the angle 535 is set in order to satisfy a near-field interference isolation criterion between the first and second antennae. For example, the angle 535 between the first and third planes is set such that the near-field interference between the first antenna 410 and the third antenna 460 is less than a threshold value (e.g., in dB). In one example, the angle 535 is between 90° to 180°. As one example, in FIG. 5B, the angle 525 is greater than the angle 535. In some implementations, the angles 525 and 535 are equal. In some implementations, the angles 525 and 535 are different.

In various implementations, the distance 474 between the first antenna mount 420 and the third antenna mount 465 in the inclined antennae arrangement 550 shown in FIG. 5B is less than the distance 335 between the first antenna mount 320 and the second antenna mount 340 arranged in a same plane in FIG. 3 due to increased spatial diversity between the first and second antennae. Put another way, if the first and third antenna mounts were located in a same plane (as is the case with antenna mounts 320, 340 in FIG. 3), the distance between the first and third antenna mounts (e.g., the distance 335 in FIG. 3) to establish spatial diversity between the first and third antennae would be greater than the distance between the first and third antenna mounts (e.g., the distance 474 in FIG. 5B) in the inclined antennae arrangement 550 in FIG. 5B. As such, the inclined antennae arrangement 550 in FIG. 5B provides mutual isolation between the first antenna 410 and the third antenna 460, which operate in substantially overlapping frequency bands, to reduce antenna-to-antenna near-field interference.

As a result, the effective spatial distance between the first antenna 410 and the third antenna 460 is increased without increasing the physical distance between the first antenna mount 420 and the third antenna mount 465 and/or the size/form factor of the apparatus including the first antenna 410, the second antenna 430, and the third antenna 460 (e.g., a wireless AP, switch, or network router). For example, the inclined antennae arrangement 550 in FIG. 5B eliminates or at least substantially reduces the effect of side lobes 466 on the main lobe 412 of the first antenna 410. Continuing with this example, the inclined antennae arrangement 550 in FIG. 5B eliminates or at least substantially reduces the effect of side lobes 414 on the main lobe 462 of the third antenna 460.

Figure 6:
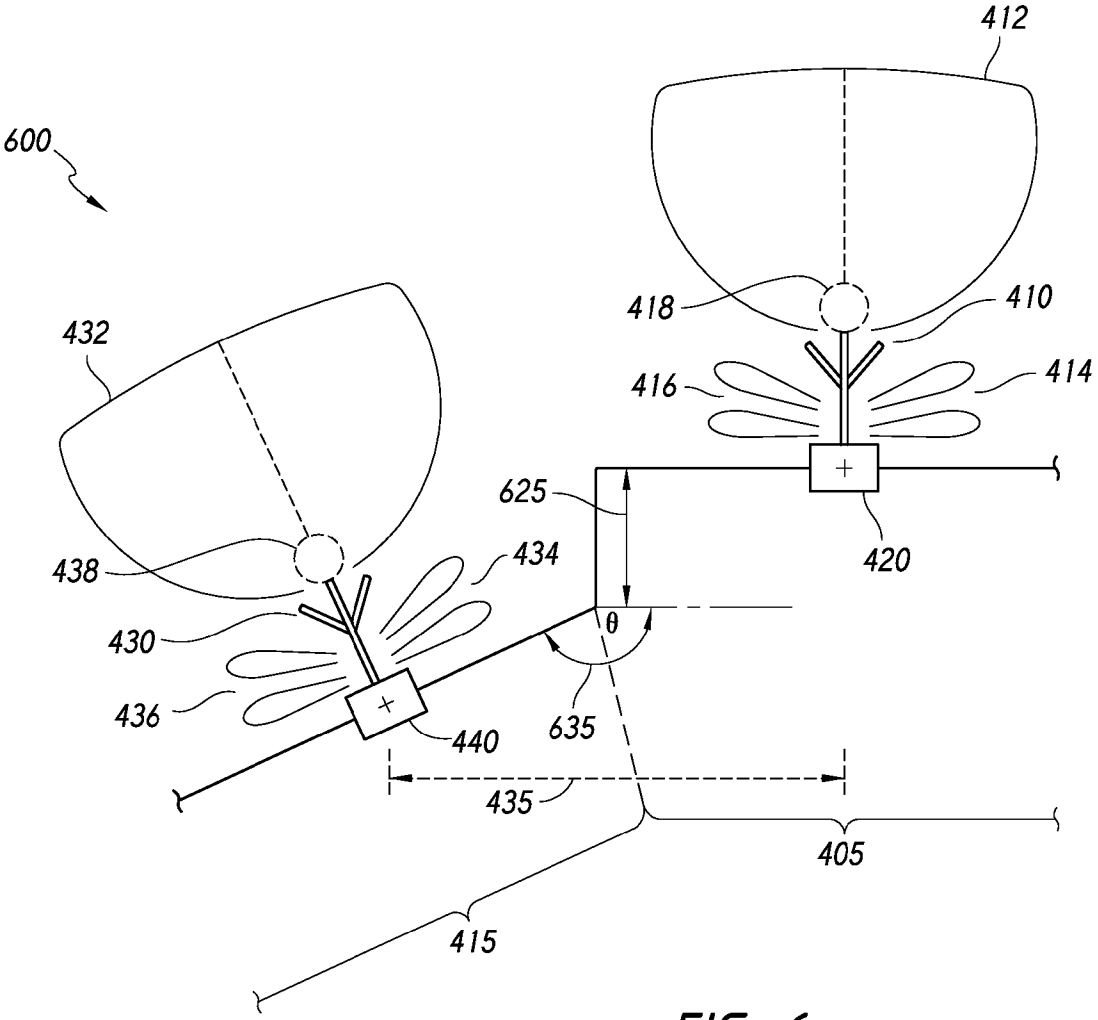
FIG. 6 is a side view of an example antennae arrangement in accordance with some implementations.

FIG. 6 is a side view of an example antennae arrangement 600 in accordance with some implementations. In FIG. 6, the components of the antennae arrangement 600 are similar to and adapted from those discussed above with reference to the tiered antennae arrangement 400 in FIG. 4A. Elements common to FIGS. 4A and 6 include common reference numbers, and only the differences between FIGS. 4A and 6 are described herein for the sake of brevity. To that end, in accordance with some implementations, the antennae arrangement 600 includes a first reflector portion 405 having a first antenna mount 420 provided for a first antenna 410 and a second reflector portion 415 having a second antenna mount 440 provided for a second antenna 430. In some implementations, the first reflector portion 405 and the second reflector portion 415 form a common ground plane. For example, the first reflector portion 405 and the second reflector portion 415 are electrically and/or mechanically coupled as shown in FIG. 6.

In some implementations, the first reflector portion 405 is defined by a first plane, and the second reflector portion 415 is defined by a second plane. In some implementations, the first reflector portion 405 resides in the first plane, and the second reflector portion 415 resides in the second plane. As shown in FIG. 6, the second plane characterizing the second reflector portion 415 is offset from the first plane characterizing the first reflector portion 405 by an offset 625. Moreover, as shown in FIG. 6, the second plane characterizing the second reflector portion 415 intersects the first plane characterizing the first reflector portion 405 at angle 635. In other words, the first reflector portion 405 and the second reflector portion 415 are disposed in an offset, inclined antennae arrangement in FIG. 6. In some implementations, the offset 625 and the angle 635 are set in order to satisfy a near-field interference isolation criterion between the first and second antennae. For example, the offset 625 and the angle 635 between the first and second planes is set such that the near-field interference between the first antenna 410 and the second antenna 430 is less than a threshold value (e.g., in dB). In one example, the angle 635 is between 90° to 180°.

In some implementations, the distance 435 between the first antenna mount 420 and the second antenna mount 440 in the antennae arrangement 600 shown in FIG. 6 is less than the distance 335 between the first antenna mount 320 and the second antenna mount 340 arranged in a same plane in FIG. 3 due to increased spatial diversity between the first and second antennae. Put another way, if the first and second antenna mounts were located in a same plane (as is the case with antenna mounts 320, 340 in FIG. 3), the distance between the first and second antenna mounts (e.g., the distance 335 in FIG. 3) to establish spatial diversity between the first and second antennae would be greater than the distance between the first and second antenna mounts (e.g., the distance 435 in FIG. 6) in the antennae arrangement 600 in FIG. 6. As such, the antennae arrangement 600 in FIG. 6 provides mutual isolation between the first antenna 410 and the second antenna 430, which operate in substantially overlapping frequency bands, to reduce antenna-to-antenna near-field interference.

As a result, the effective spatial distance between the first antenna 410 and the second antenna 430 is increased without increasing the physical distance between the first antenna mount 420 and the second antenna mount 440 and/or the size/form factor of the apparatus including the first antenna 410 and the second antenna 430 (e.g., a wireless AP, switch, or network router). For example, the antennae arrangement 600 in FIG. 6 eliminates or at least substantially reduces the effect of side lobes 434 on the main lobe 412 of the first antenna 410. Continuing with this example, the antennae arrangement 600 in FIG. 6 eliminates or at least substantially reduces the effect of side lobes 416 on the main lobe 432 of the second antenna 430.

Figure 7A:
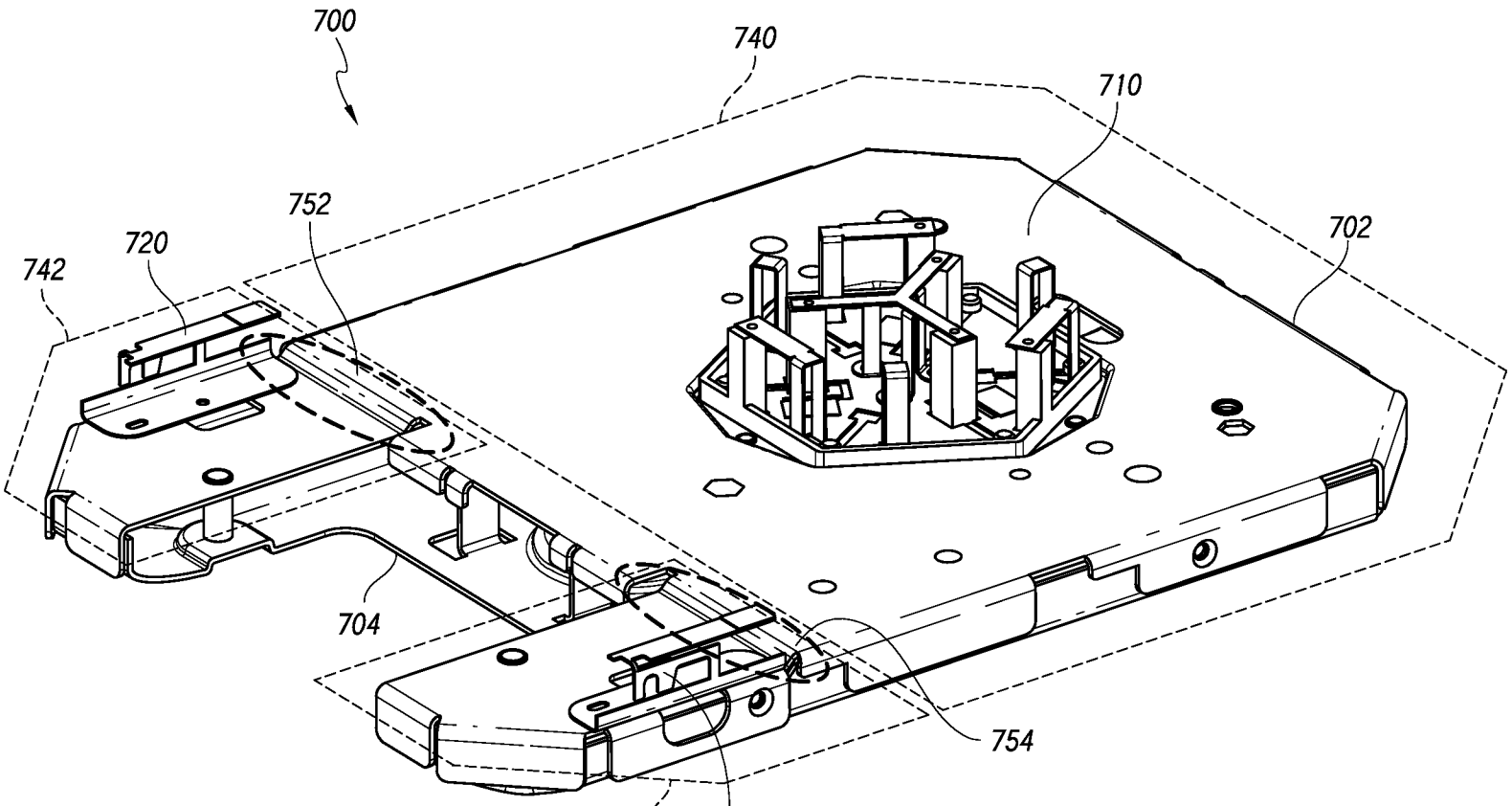
FIG. 7A is a perspective view of an apparatus in accordance with some implementations.

FIG. 7A is a perspective view of an apparatus 700 in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the apparatus 700 is a packaging for a networking device (e.g., a wireless AP, switch, or a network router). The packaging is a clamshell structure having a top section 702, to which antennae 710, 720, and 730 are mounted, and a bottom section 704. In some implementations, the apparatus 700 surrounds and encloses a substrate 715 (FIG. 7B) associated with one or more electrical components. For example, the top section 702 and the bottom section 704 are coupled using fastening hardware, an adhesive, or the like. In another example, the top section 702 and the bottom section 704 are manufactured from a single piece of metal. In yet another example, the top section 702 and the bottom section 704 are fused or welded together. In some implementations, the apparatus 700 is enclosed by a housing such as a plastic, polyvinyl chloride (PVC), etc. shell.

For convenience of explanation, the top section 702 is discussed as having a body sub-section 740, a first foot sub-section 742, and a second foot sub-section 744. Those of ordinary skill in the art will appreciate will appreciate from the present disclosure that the sub-sections illustrated in FIG. 7A are provided merely as examples. As such, in various other implementations, the sub-sections may be shaped and/or divided differently.

Figure 7B:
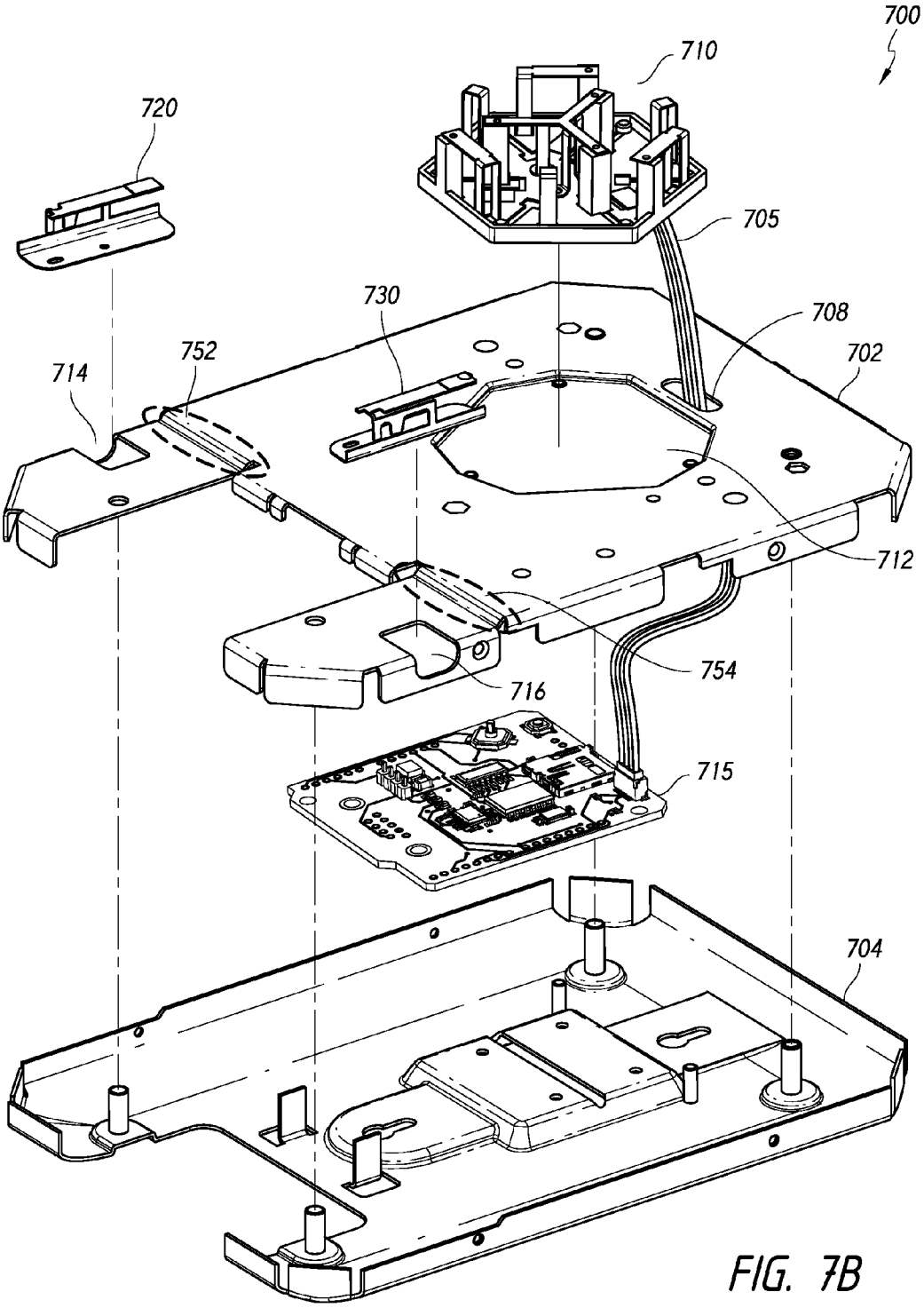
FIG. 7B is an exploded view of the apparatus in FIG. 7A in accordance with some implementations.

In some implementations, the first antenna 710 is mounted on the body sub-section 740, the second antenna 720 is mounted on the first foot sub-section 742, and the third antenna 730 is mounted on the second foot sub-section 744. As shown in FIGS. 7A-7B, the first foot sub-section 742 and the second foot sub-section are disposed in a tiered arrangement with the body sub-section 740. As such, there is a step or offset 752 between the body sub-section 740 and the first foot sub-section 742. Similarly, there is a step or offset 754 between the body sub-section 740 and the second foot sub-section 744.

In some implementations, the body sub-section 740 resides in a first plane, the first foot sub-section 742 resides in a second plane, and the second foot sub-section 744 resides in a third plane. In some implementations, the first, second, and third planes are offset, parallel planes. For example, the offset 752 is greater than the offset 754. In another example, the offset 752 is less than the offset 754. In some other implementations, the second and third planes are co-planar. For example, the offsets 752 and 754 are equal. In another example, the offsets 752 and 754 are different.

FIG. 7B is an exploded view of the apparatus 700 in FIG. 7A in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the apparatus 700 includes: antennae 710, 720, and 730; a top section 702; a substrate 715 with one or more electrical components; and a bottom section 704.

For example, the one or more electrical components on the substrate 715 include one or more processing units (CPU's), volatile memory (e.g., RAM), non-volatile memory (e.g., NAND or NOR), media access controller (MAC), physical transceiver (PHY), radios, power amplifiers (PAs), low noise amplifiers (LNAs), front-end modules (FEMs), diplexers, filters, light-emitting diodes (LEDs), connectors (e.g., RF or RJ45). In some implementations, the antenna 710 is coupled to an electrical component (e.g., a modulator/demodulator component, an A/D or D/A component, a signal driver, and/or the like) associated with the substrate 715 via a cable 705 that extends through a hole 708 in the top section 702 of the apparatus 700. In some implementations, the antennae 720 and 730 are also coupled (not shown) to electrical components associated with the substrate 715. In some implementations, as shown in FIG. 7B, the apparatus 700 includes an antenna mount 712 for receiving and mounting antenna 710, an antenna mount 714 for receiving and mounting antenna 720, and an antenna mount 716 for receiving and mounting antenna 730.

Figure 8:
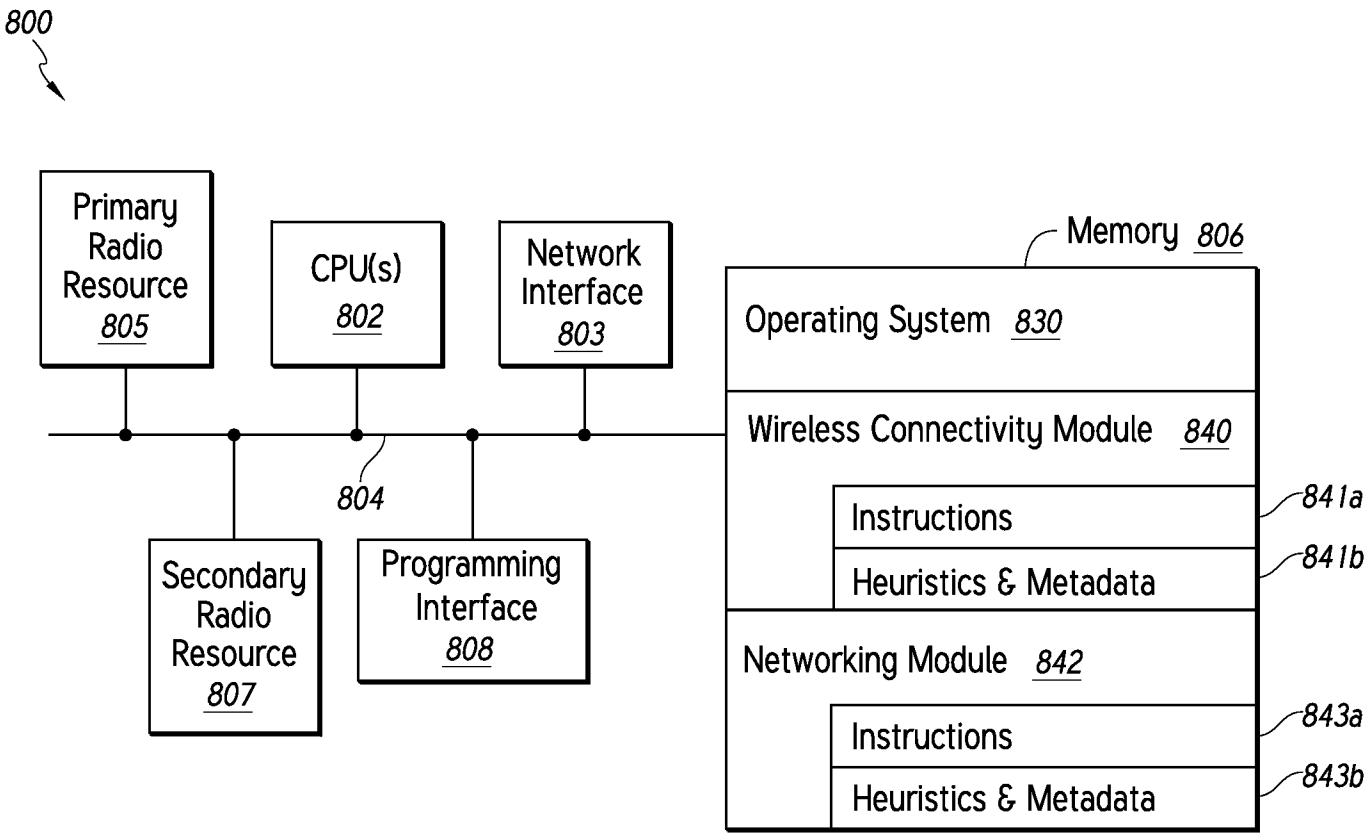
FIG. 8 is a block diagram of a computing device in accordance with some implementations.

FIG. 8 is a block diagram of a computing device 800 in accordance with some implementations. For example, in some implementations, the computing device 800 is a representation of the networking device 110 in FIGS. 1-2. While certain specific features are illustrated, those skilled in the art will appreciate from the present disclosure that various other features have not been illustrated for the sake of brevity, and so as not to obscure more pertinent aspects of the implementations disclosed herein. To that end, as a non-limiting example, in some implementations the computing device 800 includes one or more processing units (CPU's) 802 (e.g., processors or cores), a network interfaces 803, a memory 806, a programming interface 808, a primary radio resource 805, a secondary radio resource 807, and one or more communication buses 804 for interconnecting these and various other components.

In some implementations, the one or more communication buses 804 include circuitry that interconnects and controls communications between system components. The memory 806 includes high-speed random access memory, such as DRAM, SRAM, DDR RAM or other random access solid state memory devices; and may include non-volatile memory, such as one or more magnetic disk storage devices, optical disk storage devices, flash memory devices, or other non-volatile solid state storage devices. The memory 806 optionally includes one or more storage devices remotely located from the CPU(s) 802. The memory 806 comprises a non-transitory computer readable storage medium. Moreover, in some implementations, the memory 806 or the non-transitory computer readable storage medium of the memory 806 stores the following non-exclusive programs, modules and data structures, or a subset thereof including an operating system 830, a wireless connectivity module 840, and a networking module 842. In some implementations, one or more instructions are included in a combination of logic and non-transitory memory.

In some implementations, the primary radio resource 805 is provided to support and facilitate traffic bearing communications between the computing device 800 and one or more client devices (e.g., the devices 120-1, . . . , 120-N shown in FIG. 1). In some implementations, the primary radio resource 805 includes first and second radio transceivers. For example, the first radio transceiver operates according to IEEE 802.11n, IEEE 802.11ac, or IEEE 802.15, and the second radio transceiver operates according to BLUETOOTH. In some implementations, the primary radio resource 805 includes one radio transceiver. In some implementations, the secondary radio resource 807 is provided to scan available channels in order to identify neighboring wireless APs, and includes at least one radio receiver—which may be a third radio in various implementations.

In some implementations, the operating system 830 includes procedures for handling various basic system services and for performing hardware dependent tasks.

In some implementations, the wireless connectivity module 840 is configured to provide wireless connectivity to a number of client devices (e.g., the devices 120-1, . . . , 120-N in FIG. 1) using the primary radio resource 805 operating according to any of a number of various wireless networking protocols such as IEEE 802.11b, IEEE, 802.11g, IEEE 802.11n, IEEE 802.11ac, or the like. To that end, the wireless connectivity module 840 includes a set of instructions 841*a* and heuristics and metadata 841*b*.

In some implementations, the networking module 842 is configured to route information between a network (e.g., the network 105 in FIG. 1) and the number of client devices (e.g., the devices 120-1, . . . , 120-N in FIG. 1). To that end, the networking module 842 includes a set of instructions 843*a* and heuristics and metadata 843*b*.

Although the wireless connectivity module 840 and the networking module 842 are illustrated as residing on a single computing device 800, it should be understood that in other implementations, any combination of the wireless connectivity module 840 and the networking module 842 may reside in separate computing devices. For example, each of the wireless connectivity module 840 and the networking module 842 may reside on a separate computing device.

Moreover, FIG. 8 is intended more as functional description of the various features which may be present in a particular embodiment as opposed to a structural schematic of the implementations described herein. As recognized by those of ordinary skill in the art, items shown separately could be combined and some items could be separated. For example, some functional modules shown separately in FIG. 8 could be implemented in a single module and the various functions of single functional blocks could be implemented by one or more functional blocks in various implementations. The actual number of modules and the division of particular functions and how features are allocated among them will vary from one embodiment to another, and may depend in part on the particular combination of hardware, software and/or firmware chosen for a particular embodiment.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first antenna could be termed a second antenna, and, similarly, a second antenna could be termed a first antenna, which changing the meaning of the description, so long as all occurrences of the "first antenna" are renamed consistently and all occurrences of the "second antenna" are renamed consistently. The first antenna and the second antenna are both antennae, but they are not the same antenna.

The terminology used herein is for the purpose of describing particular embodiments only and is not intended to be limiting of the claims. As used in the description of the embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. An apparatus comprising:

a first reflector portion having a first mount for a first antenna that is configured to operate in a first frequency range, wherein the first mount characterizes an emission point of a main lobe of the first antenna; and a second reflector portion having a second mount for a second antenna that is configured to operate in a second frequency range that overlaps the first frequency range, wherein the second mount characterizes an emission point of a main lobe of the second antenna;

wherein the first reflector portion is at least in part arranged in a first plane and the second reflector portion is at least in part arranged in a second plane that is different from the first plane in order to satisfy a near-field interference isolation criterion between the first and second antennae, and a first distance between the first and second mounts is less than a second distance between the first and second antenna mounts arranged in the first plane due to increased spatial diversity between the first and second antennae.

2. The apparatus of claim 1, wherein the first plane characterizing the first reflector portion is offset from and parallel to the second plane characterizing the second reflector portion, wherein the offset is set in order to satisfy the near-field interference isolation criterion between the first and second antennae.

3. The apparatus of claim 1, wherein the second plane characterizing the second reflector portion intersects the first plane characterizing the first reflector portion at an angle, wherein the angle is set in order to satisfy the near-field interference isolation criterion between the first and second antennae.

4. The apparatus of claim 1, wherein:

the first plane is characterized by at least one of a tangential plane relative to a point on the first reflector portion and the first reflector portion resides in the first plane; and the second plane is characterized by at least one of a tangential plane relative to a point on the second reflector portion and the second reflector portion resides in the second plane.

5. The apparatus of claim 1, wherein:

a direction of the main lobe of the first antenna is perpendicular to and away from the first plane; and a direction of the main lobe of the second antenna is perpendicular to and away from the second plane.

6. The apparatus of claim 1, wherein the first and second reflector portions are coupled to form a common ground plane.

7. The apparatus of claim 1, further comprising:

a third reflector portion having a third mount for a third antenna that is configured to operate in a third frequency range that overlaps the first frequency range, wherein the third mount characterizes an emission point of a main lobe of the third antenna;

wherein the third reflector portion is arranged relative to at least the first reflector portion in order to satisfy a near-field interference isolation criterion between the first and third antennae, wherein the distance between the third and first mounts is less than a distance between the third and first mounts arranged in the plane due to increased spatial diversity between the first and third antennae.

8. The apparatus of claim 7, wherein: the first, second, and third reflector portions reside in respective offset, parallel planes; a first offset between the first and second reflectors portions is set in order to satisfy the near-field interference isolation criterion between the first and second antennae; and a second offset between the first and third reflectors portions are set in order to satisfy the near-field interference isolation criterion between the first and third antennae.

9. The apparatus of claim 7, wherein: the first reflector portion resides the first plane; and the second and third reflector portions reside in the second plane, wherein the second plane is parallel to and offset from the first plane, wherein the offset is set in order to satisfy the near-field interference isolation criterion between the first and second antennae.

10. The apparatus of claim 7, wherein: the second plane characterizing the second reflector portion intersects the first plane characterizing the first reflector portion at a first angle, wherein the first angle is set in order to satisfy the near-field interference isolation criterion between the first and second antennae; and a third plane characterizing the third reflector portion intersects the first plane characterizing the first reflector portion at a second angle, wherein the second angle is set in order to satisfy the near-field interference isolation criterion between the first and third antennae.

11. The apparatus of claim 1, wherein the first antenna operates in at least one additional frequency range distinct from the first frequency range.

12. The apparatus of claim 1, wherein the first antenna comprises one of: two receive chains and two transmit chains in order to support two spatial streams; three receive chains and three transmit chains in order to support three spatial streams; and four receive chains and four transmit chains in order to support four spatial streams.

13. A device comprising:

a substrate having one or more electrical components;

a first reflector portion having a first mount for a first antenna configured to operate in a first frequency range, wherein the first mount characterizes an emission point of a main lobe of the first antenna; and a second reflector portion having a second mount for a second antenna configured to operate in a second frequency range that overlaps the first frequency range, wherein the second mount characterizes an emission point of a main lobe of the second antenna;

wherein the second reflector portion is arranged relative to the first reflector portion in order to satisfy a near-field interference isolation criterion between the first and second antennae, and wherein the distance between the first and second mounts is less than a distance between the first and second mounts arranged in a plane due to increased spatial diversity between the first and second antennae.

14. The device of claim 13, further comprising:

the first and second antennae.

15. The device of claim 13, wherein the first and second reflector portions form at least a portion of an enclosure configured to house at least a portion of the substrate.

16. The device of claim 13, wherein:

the first reflector portion is defined by a first plane; and the second reflector portion is defined by a second plane.

17. The device claim 16, wherein the first plane characterizing the first reflector portion is offset from and parallel to the second plane characterizing the second reflector portion, wherein the offset is set in order to satisfy the near-field interference isolation criterion between the first and second antennae.

18. The device of claim 16, wherein the second plane characterizing the second reflector portion intersects the first plane characterizing the first reflector portion at an angle, wherein the angle is set in order to satisfy the near-field interference isolation criterion between the first and second antennae.

19. A system comprising:

a first reflector portion having a first mount for a first antenna configured to operate in a first frequency range, wherein the first mount characterizes an emission point of a main lobe of the first antenna;

a second reflector portion having a second mount for a second antenna configured to operate in a second frequency range that overlaps the first frequency range, wherein the second mount characterizes an emission point of a main lobe of the second antenna; and the first and second antennae;

wherein the first reflector portion is at least in part arranged in a first plane and the second reflector portion is at least in part arranged in a second plane that is different from the first plane in order to satisfy a near-field interference isolation criterion between the first and second antennae, and wherein a first distance between the first and second mounts is less than a second distance between the first and second mounts arranged in the first plane due to increased spatial diversity between the first and second antennae.

* * * * *